US007173567B2

(12) United States Patent
Inatsugu et al.

(10) Patent No.: US 7,173,567 B2
(45) Date of Patent: Feb. 6, 2007

(54) ANTENNA

(75) Inventors: Susumu Inatsugu, Osaka (JP); Hirotaka Ishihara, Osaka (JP); Koichi Ogawa, Osaka (JP); Tomoyuki Maeda, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/756,982

(22) Filed: Jan. 14, 2004

(65) Prior Publication Data

US 2004/0263407 A1 Dec. 30, 2004

(30) Foreign Application Priority Data

Jan. 16, 2003 (JP) ..... 2003-007980

(51) Int. Cl.
*H01Q 1/24* (2006.01)

(52) U.S. Cl. ..... 343/702

(58) Field of Classification Search ..... 343/700 MS, 343/815–818, 711–713, 702, 895, 866, 741, 343/742

See application file for complete search history.

(56) References Cited

U.S. PATENT DOCUMENTS 4,860,020 A 8/1989 Wong et al.
6,028,567 A * 2/2000 Lahti ..... 343/895
6,040,803 A * 3/2000 Spall ..... 343/700 MS
6,249,255 B1 * 6/2001 Eggleston ..... 343/702
6,456,246 B2 * 9/2002 Saito ..... 343/702
6,459,413 B1 * 10/2002 Tseng et al. ..... 343/702
6,624,795 B2 * 9/2003 Boyle ..... 343/895
6,697,023 B1 * 2/2004 Tiao-Hsing et al. ..... 343/702
2002/0080088 A1 6/2002 Boyle

FOREIGN PATENT DOCUMENTS

JP 62-122401 6/1987
WO WO 03/003515 A 1/2003

OTHER PUBLICATIONS

European Search Report for EP 04 00 0866, dated Mar. 22, 2004.

* cited by examiner

*Primary Examiner*—Trinh Dinh
*Assistant Examiner*—Huedung Mancuso
(74) *Attorney, Agent, or Firm*—RatnerPrestia

(57) ABSTRACT

The antenna of the present invention comprises flat-plate conductive ground plane 1, first antenna element 13 with one end 13*a* connected to feeding point 2 and intermediate portion 13*b* folded by a plurality of times, which is extended upward from the ground plane 1, and second antenna element 23 with one end 23*a* connected to the other end 13*c* of the first antenna element 13, with intermediate portion 23*b* formed in symmetrical relation to the first antenna element 13, and also, with the other end 23*c* connected to the ground plane 1. Thus, it is possible to obtain a small size antenna with the antenna element lowered in height.

8 Claims, 11 Drawing Sheets

(a)

(b)

PRIOR ART

ANTENNA

BACKGROUND OF THE INVENTION

1. Field of the Invention

The present invention relates to an antenna used for mobile radio equipment to be mounted on a vehicle or the like.

2. Description of the Related Art

Recently, a linear mono-pole antenna or a folded mono-pole antenna is generally employed as an antenna for mobile radio equipment to be mounted on a vehicle.

Such a conventional antenna will be described in the following with reference to FIG. 11.

FIG. 11(*a*) is a side view of a conventional mono-pole antenna. The conventional mono-pole antenna comprises a flat-plate conductive ground plane 91 made from copper material or the like, a feeding point 92 positioned at the center of the ground plane 91, and an antenna element 93 made from linear copper material or the like. The antenna element 93, with one end connected to the feeding point 92 and the other end opened, is vertically extended by height h against the ground plane 91. The mono-pole antenna is configured in this way.

Also, FIG. 11(*b*) is a side view of a conventional folded mono-pole antenna. The conventional folded mono-pole antenna has an antenna element 103 made from linear copper material or the like which is folded in U-shape. The antenna element 103, with one end connected to the feeding point 92, is vertically extended by height h against the ground plane 91, and its upper part is folded in U-shape, while the other end is connected to the ground plane 91. The folded mono-pole antenna is configured in this way.

In any of the antennas configured as described above, when high-frequency current of operating frequency is supplied to the feeding point 92, the antenna elements 93, 103 are excited to perform signal transmitting operation. Also, in signal reception, the antenna elements 93, 103 are excited by the high-frequency electromagnetic field of operating frequency to perform signal receiving operation.

The mono-pole antenna is formed so that one end of the antenna element 93 is connected to the feeding point 92 and the other end thereof is opened. Therefore, current (i1) across a–b and image current (i1) equivalent to across a–b flow in same phase to the ground plane 91. The mono-pole antenna is excited in this way, and then electromagnetic waves are emitted into the air.

On the other hand, the folded mono-pole antenna is formed so that the antenna element 103 is folded in U-shape. Therefore, in addition to current (i1) across a–b and current (i3) across c–d, image current (i1, i3) equivalent to across a–b and across c–d flows in same phase to the ground plane 91. Since the folded mono-antenna is enhanced in excitation by using such a configuration, the band width of the antenna can be expanded.

As preceding technical document information regarding the invention of this application, for example, Japanese Laid-open Patent S62-122401 is well known.

However, as in a conventional mono-pole antenna and a folded mono-pole antenna described above, the antenna is generally operated in a ¼ wavelength mode. Therefore, the mechanical height h is required to be at least ¼ wavelength of operating frequency. For example, in the case of 900 MHz band used for cellular phones, the height required is at least 83 mm that is equivalent to ¼ wavelength thereof.

Accordingly, for the reduction in size of the antenna, if the mechanical height h of the antenna element is lowered by making the height shorter than ¼ wavelength of operating frequency, then the antenna impedance is decreased, and there arises a problem that it is difficult to adjust impedance matching.

Also, when the above conventional antenna is installed on a rear tray or dashboard in a vehicle, it is desirable to face the antenna elements 93, 103 upward in order to improve the electromagnetic wave emission efficiency of the antenna. However, if the antenna elements 93, 103 are faced upward, a large space is occupied by the antenna elements 93, 103 in the direction of height, and there arises a problem of causing inconvenience in use of the antenna in a vehicle.

SUMMARY OF THE INVENTION

The present invention is intended to solve such a problem, and the object of the invention is to provide a small size antenna with its antenna element lowered in height.

In order to achieve the purpose, the antenna of the present invention comprises a flat-plate ground plane;

a first antenna element with its one end connected to a feeding point and its intermediate portion folded by a plurality of times, which is extended upward from the ground plane; and a second antenna element with its one end connected to the other end of the first antenna and with the other end thereof connected to the ground plane, which has an intermediate portion extended upward from the ground plane, wherein the intermediate portion of the second antenna element is disposed in a symmetrical relation with the intermediate portion of the first antenna element.

Further, the antenna of the present invention is disposed in such arrangement that the intermediate portion of the first antenna element and the intermediate portion of the second antenna are symmetrically opposed to each other.

Also, the antenna of the present invention comprises a substrate extended upward from the ground plane, and the intermediate portion of the first antenna element is disposed on one surface of the substrate, while the intermediate portion of the second antenna element is disposed on the other surface opposing to the surface of the substrate on which the intermediate portion of the first antenna element is disposed.

In this way, since the intermediate portions of the first and the second antenna elements are folded by a plurality of times and symmetrically opposed to each other, the antenna impedance is increased, making it easier to adjust impedance matching. Further, since the intermediate portion is folded by a plurality of times and symmetrically opposed to each other, it is possible to lower the height of the antenna.

Also, the antenna of the present invention is configured in that the other end of the first antenna element is connected to one end of the second antenna element via a conductive plate. Therefore, the antenna impedance at the feeding point can be increased by the conductive plate, and the antenna can be further lowered in height. Also, the resonance frequency of the antenna can be easily adjusted by partially notching the conductive plate or the like, and it is possible to easily adjust the desired resonance frequency.

Further, the antenna of the present invention is configured in that the first and the second antenna elements are plate-like elements. Accordingly, the antenna elements can be easily formed by pressing or etching, and also the antenna characteristics can be stabilized.

Also, the antenna of the present invention comprises a plurality of parasitic antenna elements having intermediate portions same in shape as the intermediate portion of the first antenna element, and each of the parasitic antenna elements is disposed in parallel with the surface where the first antenna element and the second antenna element are disposed, and one end of the parasitic antenna element is connected to the ground plane, while the other end is opened. In this way, the excitation is enhanced by each antenna element and it is possible to expand the band of the antenna.

Further, the antenna of the present invention is configured in that the intermediate portion of the first antenna element and the intermediate portion of the second antenna element are symmetrically arranged on same flat surface. Thus, it is possible to reduce the thickness of the antenna.

Also, the antenna of the present invention is configured in that each line length of the first antenna element and the second antenna element is substantially an electric length of 5/4 wavelength in overall length as against the frequency band of high-frequency current supplied. That is, since the intermediate portion is folded by a plurality of times, it is possible to lower the height even in case each line length of the antenna elements is elongated. Thus, for example by making each line length of the antenna elements equivalent to the electric length of 5/4 wavelength that operates 1/4 wavelength mode, it is possible to lower the height without degrading the efficiency of radiation from the antenna into the air as compared with the conventional antenna of 1/4 wavelength line length.

DESCRIPTION OF THE PREFERRED EMBODIMENTS

The preferred embodiments of the present invention will be described in the following with reference to FIG. 1 to FIG. 10.

(First Preferred Embodiment)

Figure 1:
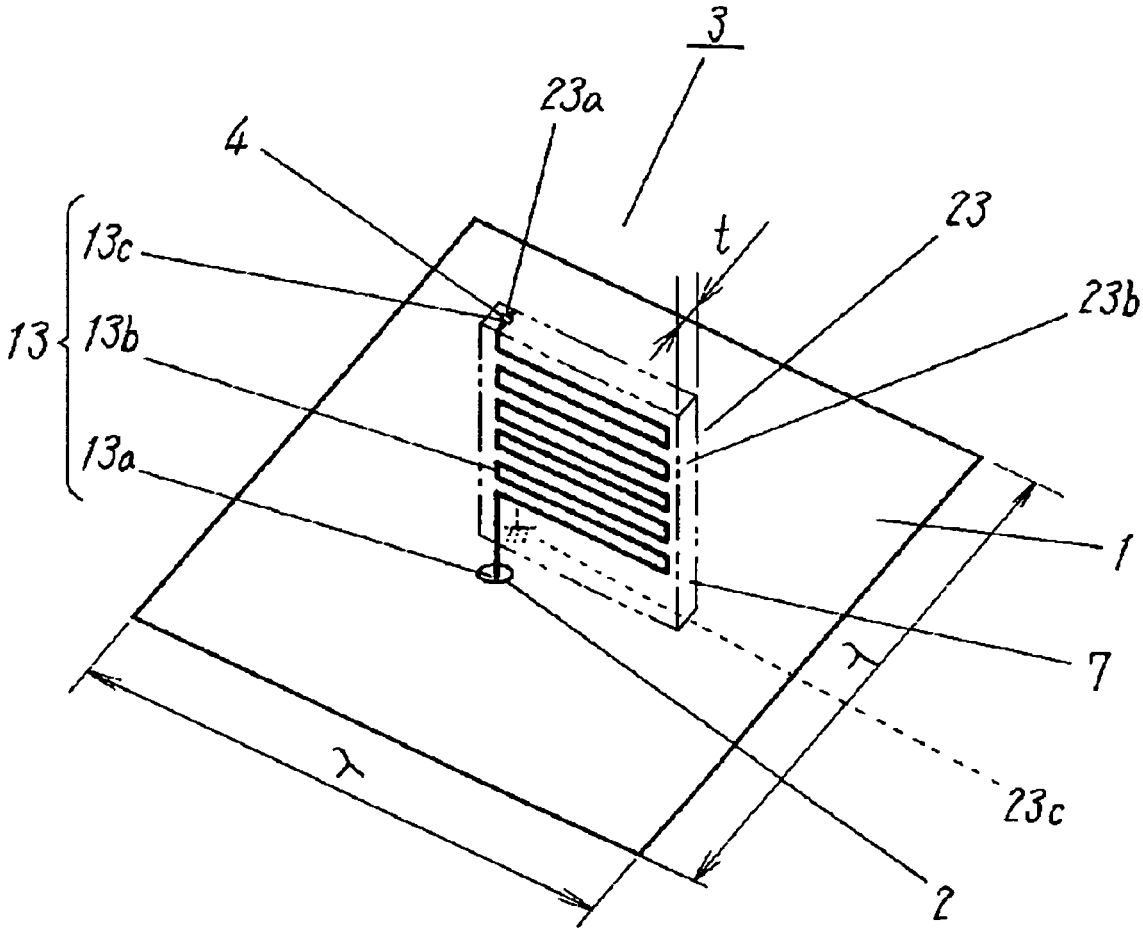
FIG. 1 is a perspective view of an antenna in the first preferred embodiment of the present invention.
Figure 2:
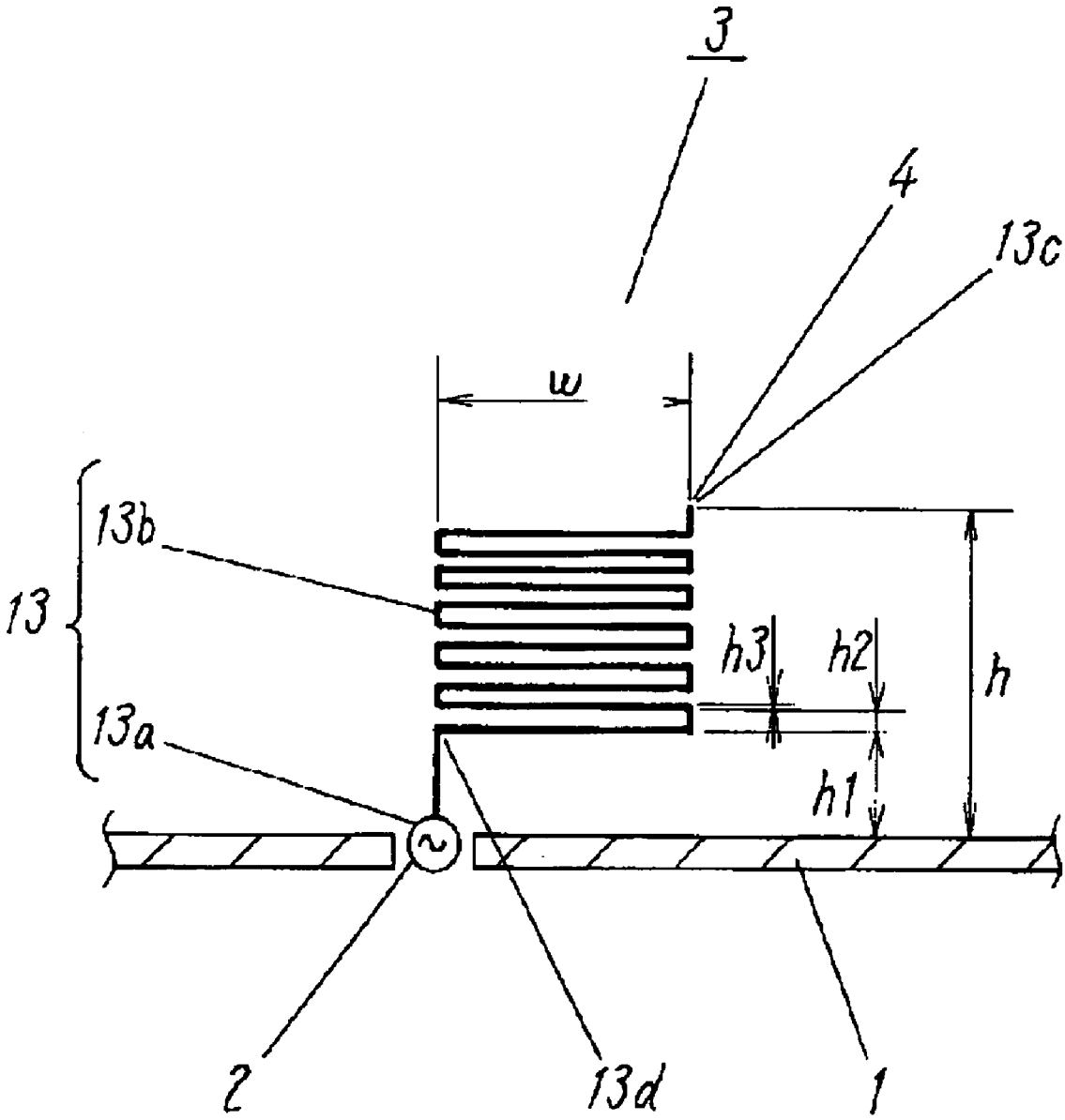
FIG. 2 is a side view of the antenna.

FIG. 1 is a perspective view of an antenna in the first preferred embodiment of the present invention, and FIG. 2 is a side view of the antenna. As shown in the figure, the antenna of the first preferred embodiment comprises flat-plate conductive ground plane 1 using copper, steel material or the like having lengthwise and widthwise dimensions of one wavelength or over each and feeding point 2 positioned at nearly the center of the ground plane 1. Further, one end 13*a* of first antenna element 13 realized by using linear or plate-like copper material is connected to the feeding point 2. The first antenna element 13 has an intermediate portion 13*b* extended upward from the ground plane 1. The intermediate portion 13*b* is folded in nearly U-shape with sharp corner by a plurality of times.

Also, one end 23*a* of second antenna element 23 using copper material or the like is similarly connected to the other end 13*c* of the first antenna element 13 by means of connecting point 4. The second antenna element 23 also has an intermediate portion 23*b* extended upward from the ground plane 1 the same as the first antenna element 13. Further, the intermediate portion 23*b* is, for example, folded in nearly U-shape with sharp corner by a plurality of times the same as the intermediate portion 13*b*. Also, the other end 23*c* of the second antenna element 23 is electrically connected to the ground plane 1.

Further, as shown in FIG. 1, the intermediate portion 23*b* of the second antenna element 23 is formed in opposing and symmetrical relation with the first antenna element 13. In the example mentioned here, the first antenna element 13 and the second antenna element 23 are arranged in opposing and symmetrical relation with each other, providing a predetermined space between them by means of substrate 7 made from resin material or the like. Using such a configuration, antenna 3 is formed as the antenna of the first preferred embodiment.

Specific manufacturing and evaluating methods in the case of using this antenna for 900 MHz band of a cellular phone or the like for example will be described in the following by using the drawings.

Described here is an example in which two sheets of antenna elements 13 and 23 are manufactured by pressing a copper plate of 0.2 mm thick and folding its intermediate portion in nearly U-shape with sharp corner by a plurality of times.

As shown in FIG. 2, one end 13*a* of the first antenna element 13 is electrically connected to the feeding point 2 by soldering. Height h1 is the height of the linear portion up to the initial bending point 13*d* of the first antenna element 13. The height h1 corresponds to 3 mm of 1/100 wavelength. Also, at the intermediate portion 13*b* extended upward from the ground plane 1, space h2 corresponds to a space formed by each U-shape of the intermediate portion 13*b*, and width h3 is the conductor width of copper plate. Each of the space h2 and conductor width h3 is 0.4 mm of 1/1000 wavelength.

Also, the substrate 7 is made from resin material such as foaming polystyrene of rectangular shape, and its dielectric constant is about 1.0 and its plate thickness t is 2 mm in the example mentioned here. The antenna elements 13 and 23 are kept opposing to each other by using the substrate 7.

Further, described here is an example in which each line length of the first and second antenna elements 13, 23 corresponds to 5/4 wavelength that is a 1/4 wavelength mode. That is, each line length of the first and second antenna elements 13, 23 is substantially an electric length of 5/4 wavelength in overall length as against the frequency band of high-frequency current supplied. For example, as in 5/4 wavelength, the line length can be made longer as compared with the line length of 1/4 wavelength by selecting an electric length of over 1/4 wavelength, and therefore, it is possible to enhance the efficiency of radiation from the antenna into the air.

As described above, since each line length of the first and second antenna elements 13, 23 folded in nearly U-shape by a plurality of times corresponds to a length of 5/4 wavelength, the antenna can be operated in 1/4 wavelength mode.

That is, in the case of the conventional example, mechanical height h is required to be 83 mm of 1/4 wavelength, while in the case of the antenna of the present invention, width w is 15 mm of 1/22 wavelength, and height h is 23 mm of 1/15 wavelength. That is, although each line length of the first and second antenna elements 13, 23 is 5/4 wavelength, it can be made lower in height as compared with the conventional example.

Figure 3:
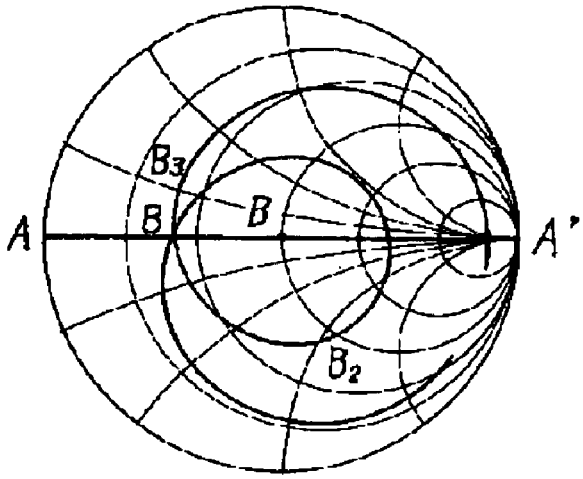
FIG. 3(*a*) to FIG. 3(*b*) are characteristic diagrams of the antenna.
Figure 3:
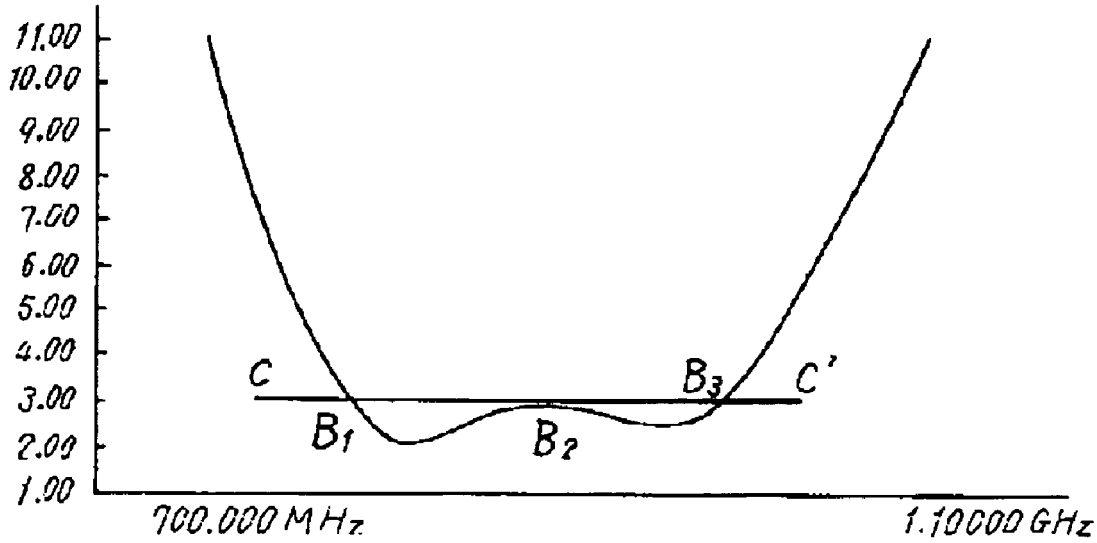

FIG. 3 is a characteristic diagram of the antenna, showing the evaluation result of the antenna manufactured as described above. FIG. 3(*a*) is a Smith chart showing impedance at operating frequencies, and FIG. 3(*b*) is a VSWR characteristic chart at operating frequencies.

In the figures, each point in the Smith chart of FIG. 3(*a*) stands for each impedance at each operating frequency (B1 is 810 MHz, B2 is 900 MHz, B3 is 960 MHz). On the line A–A', the impedance is low at A side and high at A' side, and central position B is a point of impedance matching (50 ohm in this case).

As is obvious in FIG. 3(*a*), the impedance at each operating frequency of B1, B2, B3 of the antenna manufactured is positioned near the central position B. That is, since this antenna has such characteristics, it is possible to easily adjust impedance matching by selecting the constant of an impedance matching circuit (not shown).

Also, in FIG. 3(*b*), the horizontal axis shows frequency range from 700 MHz to 1100 MHz, and the vertical axis is VSWR (voltage standing wave ratio). Each point in the figure stands for VSWR at each operating frequency (B1 is 810 MHz, B2 is 900 MHz, B3 is 960 MHz). At VSWR, the smaller the value, less is the loss due to impedance mismatching of the antenna at the operating frequency.

The horizontal line shown by C–C' line in the figure is the line of VSWR=3. Here, when the band below VSWR=3 is defined as an antenna-usable operating frequency band, the bandwidth lower than VSWR=3 is 192 MHz. That is, it shows that bandwidth 150 MHz ranging from B1 (810 MHz) to B3 (960 MHz), necessary for 900 MHz band used for cellular phones, has been assured.

In this way, since the antenna elements 13, 23 are arranged above the ground plane 1, which are symmetrically opposed to each other at predetermined intervals, forming a rectangular shape, the volume is $0.8\times10^{-6}$ $m^3$ (0.8 ml) from a product of dimensions of height h, width w, thickness t, and thereby, it is possible to reduce the size and volume.

Further, as compared with height 83 mm of the conventional mono-pole antenna and folded mono-pole antenna, the height of this antenna can be lowered to 23 mm that is nearly 1/4 of the height. Accordingly, even when this antenna is installed with antenna elements 13, 23 faced upward on a rear tray or dashboard in a vehicle, the space occupied by the antenna elements 13, 23 in the direction of height can be reduced.

Figure 4:
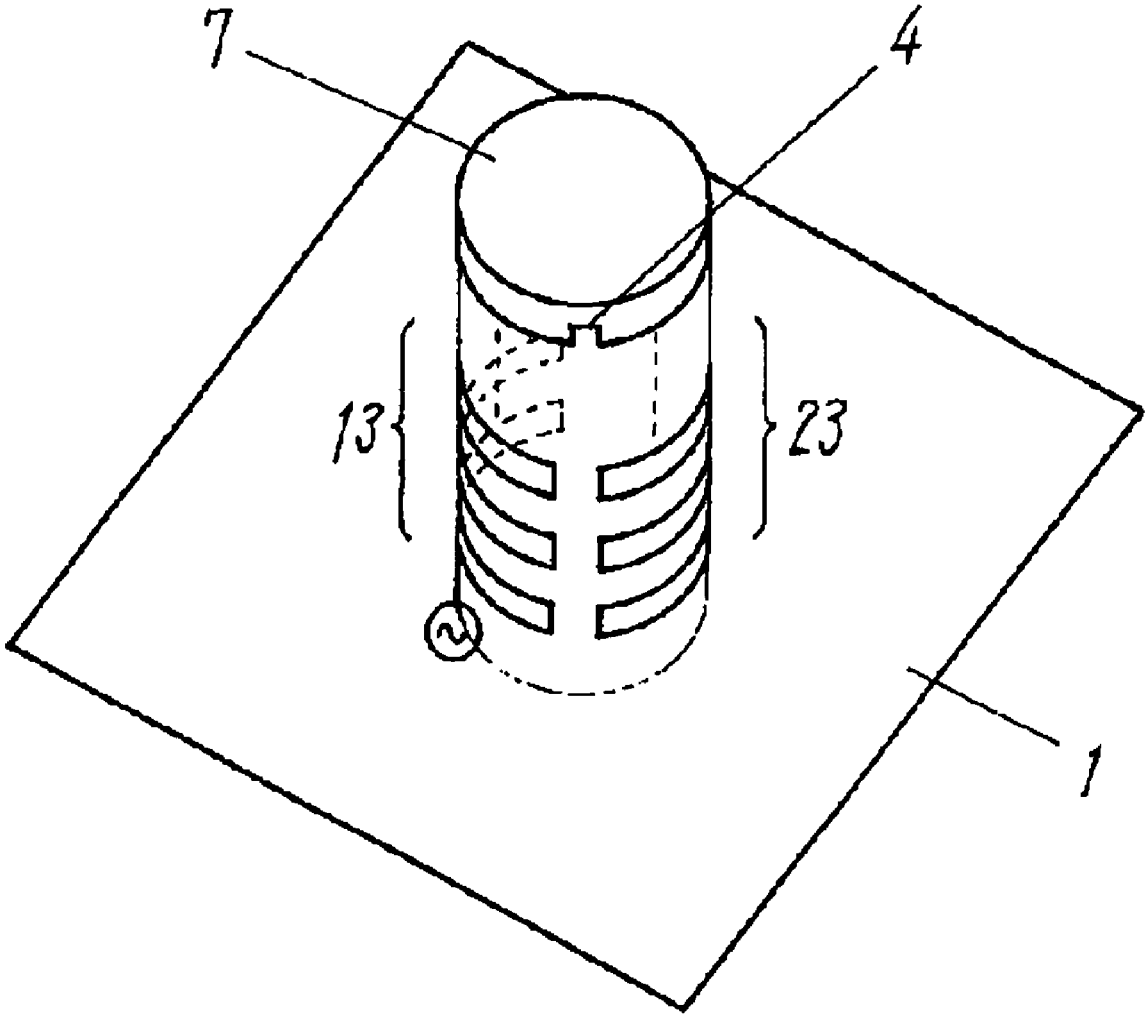
FIG. 4 is a perspective view of the antenna in another preferred embodiment.

In the present preferred embodiment, the substrate 7 is rectangular in shape in the description, the invention is not limited to this shape. For example, it is also preferable to be circular or multi-angular as shown in FIG. 4, and similar effects can be obtained by such a configuration that the first antenna element 13 and the second antenna element 23 are symmetrically opposed to each other.

Moreover, the invention is not limited that the first antenna element 13 and the second antenna element 23 are opposed to each other. For example, it is also preferable to use a substrate of polygonal prism in shape and dispose each antenna element 13 and 23 on the surfaces adjoining each other or on the surfaces leaving out space for one or more surfaces.

Figure 5:
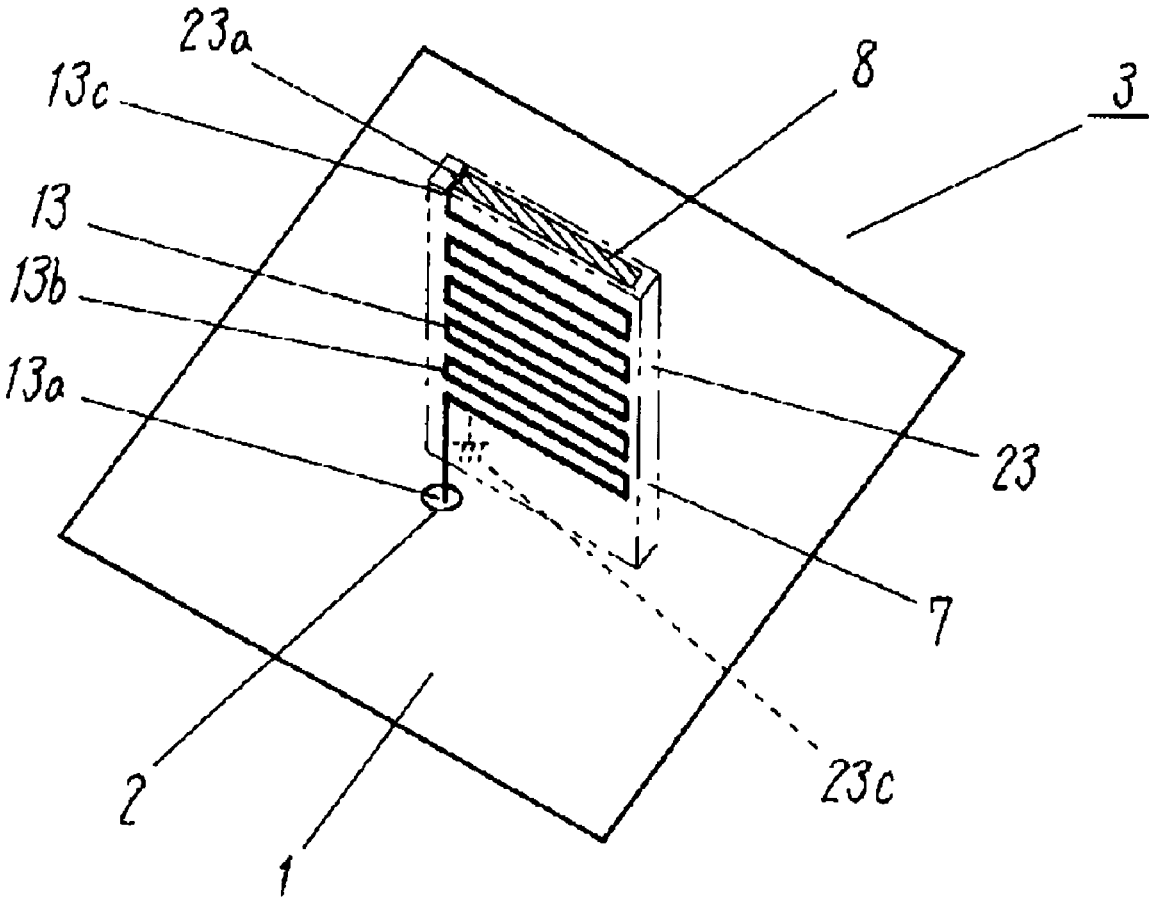
FIG. 5 is a perspective view of the antenna.

Also, as shown in the perspective view of FIG. 5, this antenna can be configured in that the other end 13*c* of the first antenna element 13 and one end 23*a* of the second antenna element 23 are connected to each other at the top via conductive plate 8 made from copper material or the like. In such a configuration, since load capacitance is arisen between the ground plane 1 and the conductive plate 8, the antenna impedance at the feeding point 2 can be further enhanced. Therefore, for example, in the case of an antenna of 900 MHz band used for cellular phones, mechanical height h can be lowered from 23 mm to 18 mm, and further, the antenna can be reduced in size.

Moreover, since the resonance frequency of the antenna can be easily adjusted by, for example, notching a part 8*a* of the conductive plate 8, it is also possible to easily obtain the desired resonance frequency.

Figure 6:
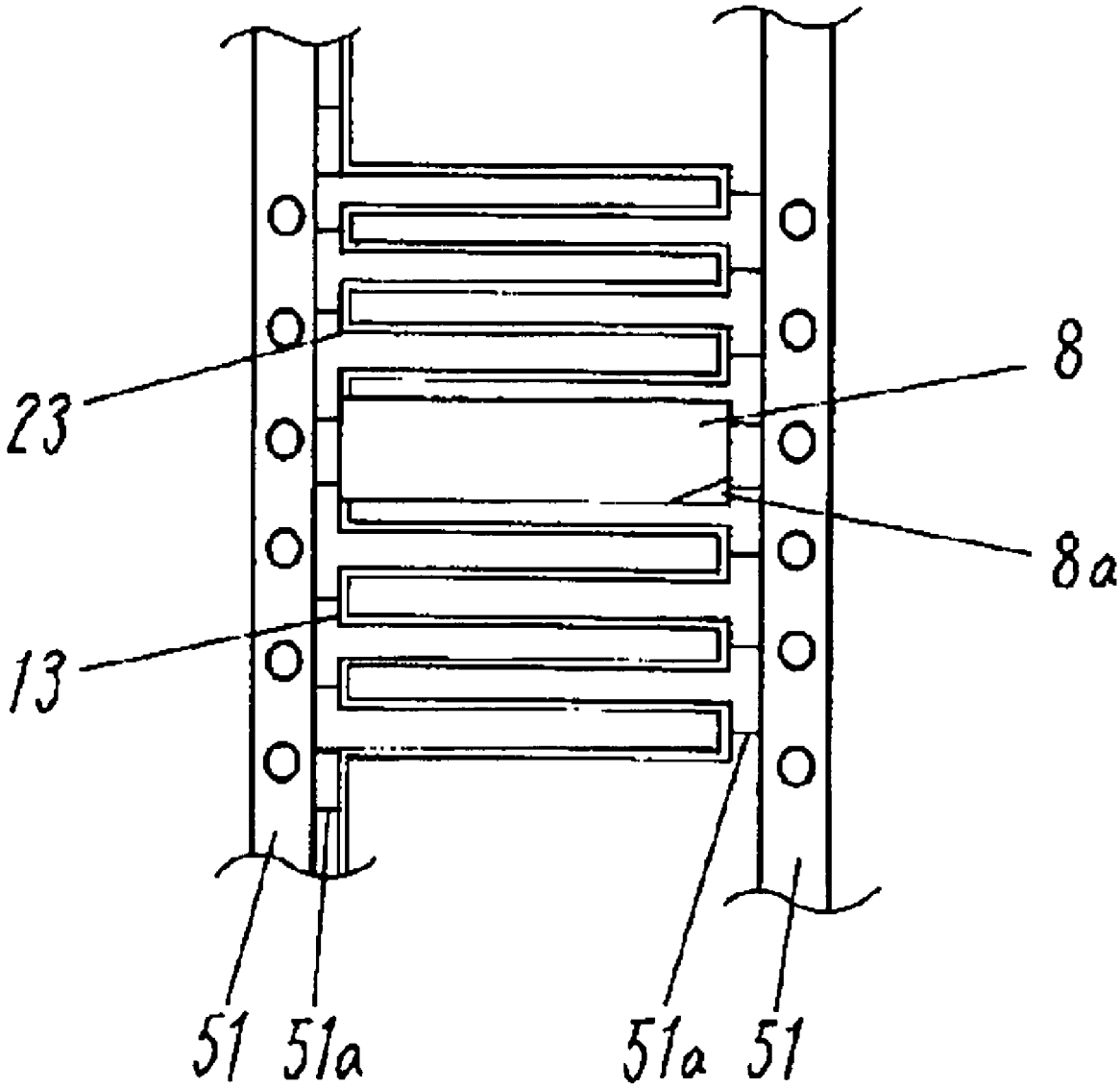
FIG. 6 is a plan view showing an example of manufacturing method for the antenna.

Also, FIG. 6 is a plan view showing a method of manufacturing an antenna. As shown in FIG. 6, the first antenna element 13, the second antenna element 23, and the conductive plate 8 are all over connected to hoop frame 51 by connecting portion 51*a*. In this way, each part of the antenna is simultaneously formed into plate shape by pressing or etching a flat plate such as plate copper material. After that, the connecting portion 51*a* are cut off by means of a press or the like, followed by integrally bending the first antenna element 13, the second antenna element 23, and the conductive plate 8 by pressing. Further, with these parts integrally three-dimensionally formed with resin or the like, an antenna of the present invention can be realized as shown in FIG. 5.

That is, since the first and second antenna elements are made from plate copper material, the antenna elements can be easily formed by pressing or etching. Further, it is possible to obtain more reliable antenna characteristics.

(Second Preferred Embodiment)

Figure 7:
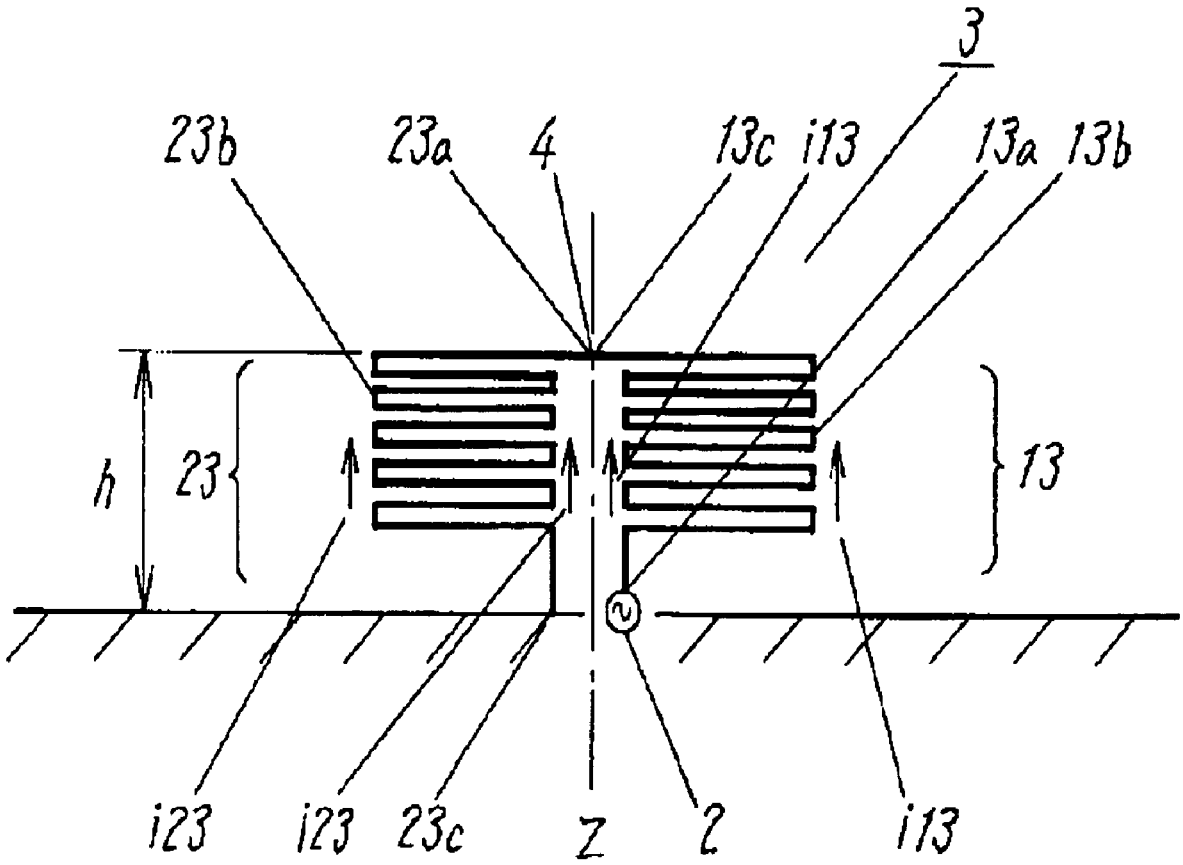
FIG. 7 is a side view of an antenna in the second preferred embodiment of the present invention.

FIG. 7 is a side view of an antenna in the second preferred embodiment of the present invention. As shown in the figure, the antenna of the second preferred embodiment is configured in that the first antenna element 13 and the second antenna element 23 made from linear or plate copper material are formed in line-symmetrical relation with each other to the Z line on same plain surface.

In the above configuration, during signal transmission, high-frequency signals are supplied from the feeding point 2 at the center of ground plane 1 to the first antenna element 13 and the second antenna element 23. Then, high-frequency current (i13) of the first antenna element 13 and high-frequency current (i23) of the second antenna element 23 are excited in same phase, and electromagnetic wave is emitted into the air. Also, in the case of signal reception, the operations are reversed to receive the signals.

According to the second preferred embodiment, since the first antenna element 13 and the second antenna element 23 are formed in line-symmetrical relation with each other on same plain surface, it is possible to obtain same antenna characteristics as in the first preferred embodiment. Further, the antenna element can be reduced in thickness, and it is possible to obtain an antenna which can be installed on a glass surface of a vehicle.

Incidentally, same effects can be obtained by arranging the disposal relation between the first antenna element 13 and the second antenna element 23 in nearly V-shape, nearly L-shape, or curved surface shape.

Also, described above is a configuration such that the intermediate portions of the first antenna element 13 and the second antenna element 23, conductors such as linear or plate copper material, are folded by a plurality of times in nearly U-shape with sharp corner. However, the intermediate portions of both antenna elements 13, 23 are, for example, preferable to be nearly V-shaped as in FIG. 8(*a*) or U-shaped with round corner as in FIG. 8(*b*), and further, spirally shaped or the like (not shown). Similar effects can be obtained if configured in that the first and second antenna elements are folded by a plurality of times to excite the high-frequency current in same phase.

Figure 8:
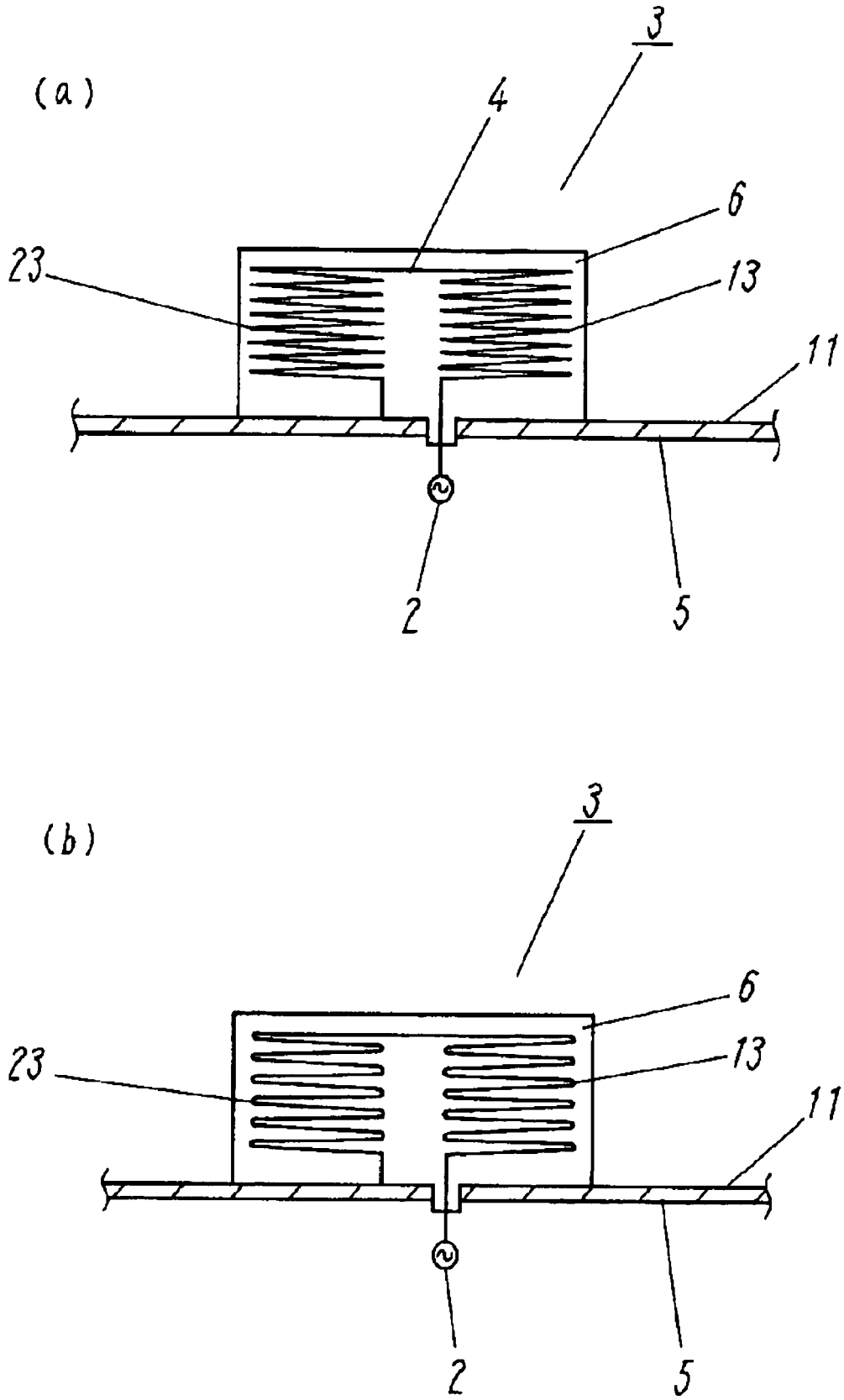
FIG. 8(*a*) to FIG. 8(*b*) are plan views of the antenna in another preferred embodiment.

Further, described above is an example such that the first antenna element 13 and the second antenna element 23 are made by machining linear or plate copper material or the like. However, as shown in FIG. 8(*a*), (b), same as in forming ground plane 11 by using copper foil of printed circuit board 5, it is also preferable to realize both antenna elements 13, 23 by forming the first antenna element 13 and the second antenna element 23 by etching the copper foil of copper-coated ceramic board or printed circuit board 6 as a substrate into a desired shape.

Thus, by forming the first and second antenna elements 13, 23 being foil-like by etching or the like, it is possible to realize an antenna which is less in dimensional alteration and having reliable characteristics.

Figure 9:
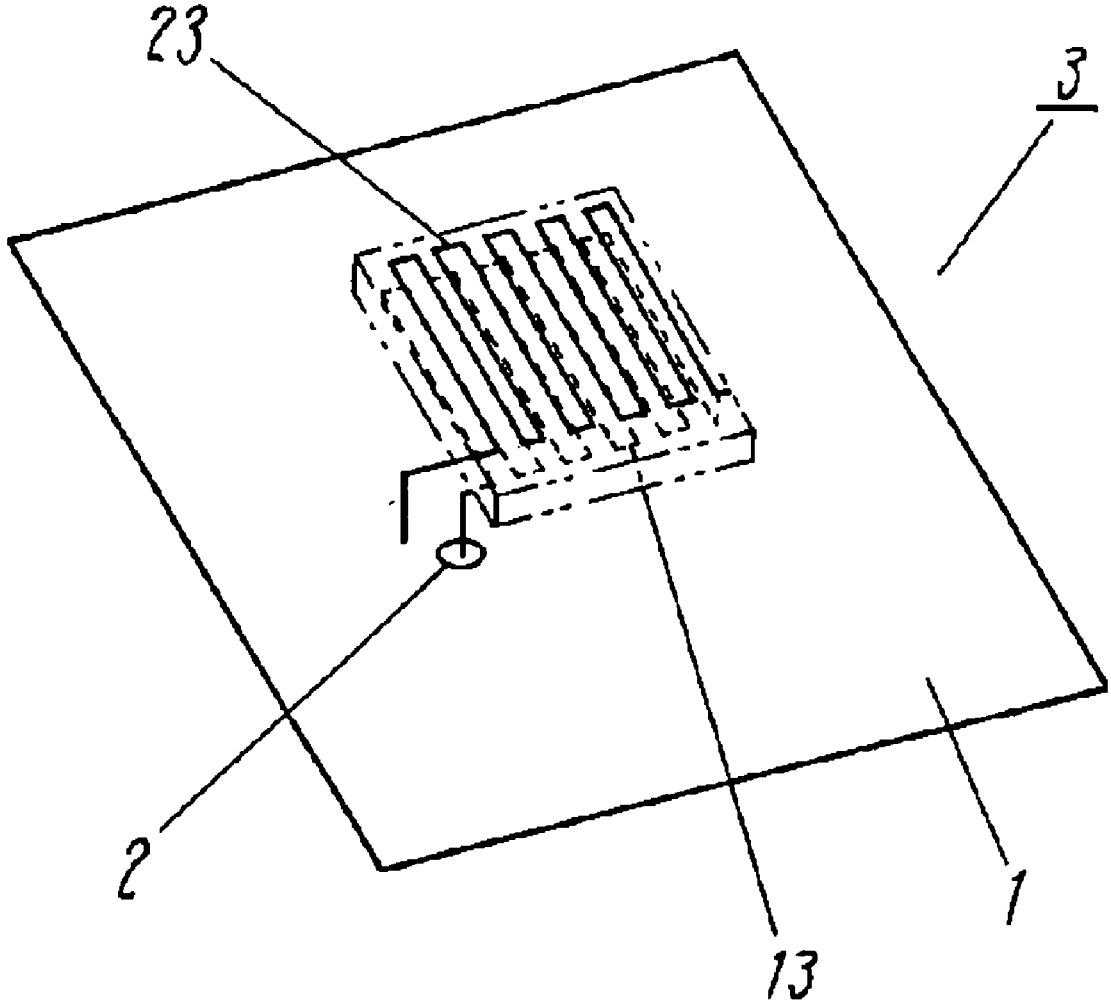
FIG. 9 is a perspective view of the antenna.

Also, as shown in FIG. 9, similar effects can be obtained by forming the intermediate portions of the first antenna element 13 and the second antenna element 23 in laterally parallel relation to the ground plane 1.

Also, mechanical height h of the first and second antenna elements 13, 23 is allowable to be other than the height of 1/15 wavelength. It is preferable to properly select space h2 and width w so that each line length of the antenna elements corresponds to the folded shape of the length of 5/4 wavelength (that is, each line length of which the antenna operates in 1/4 wavelength mode). Same effects can also be obtained in this way.

Figure 10:
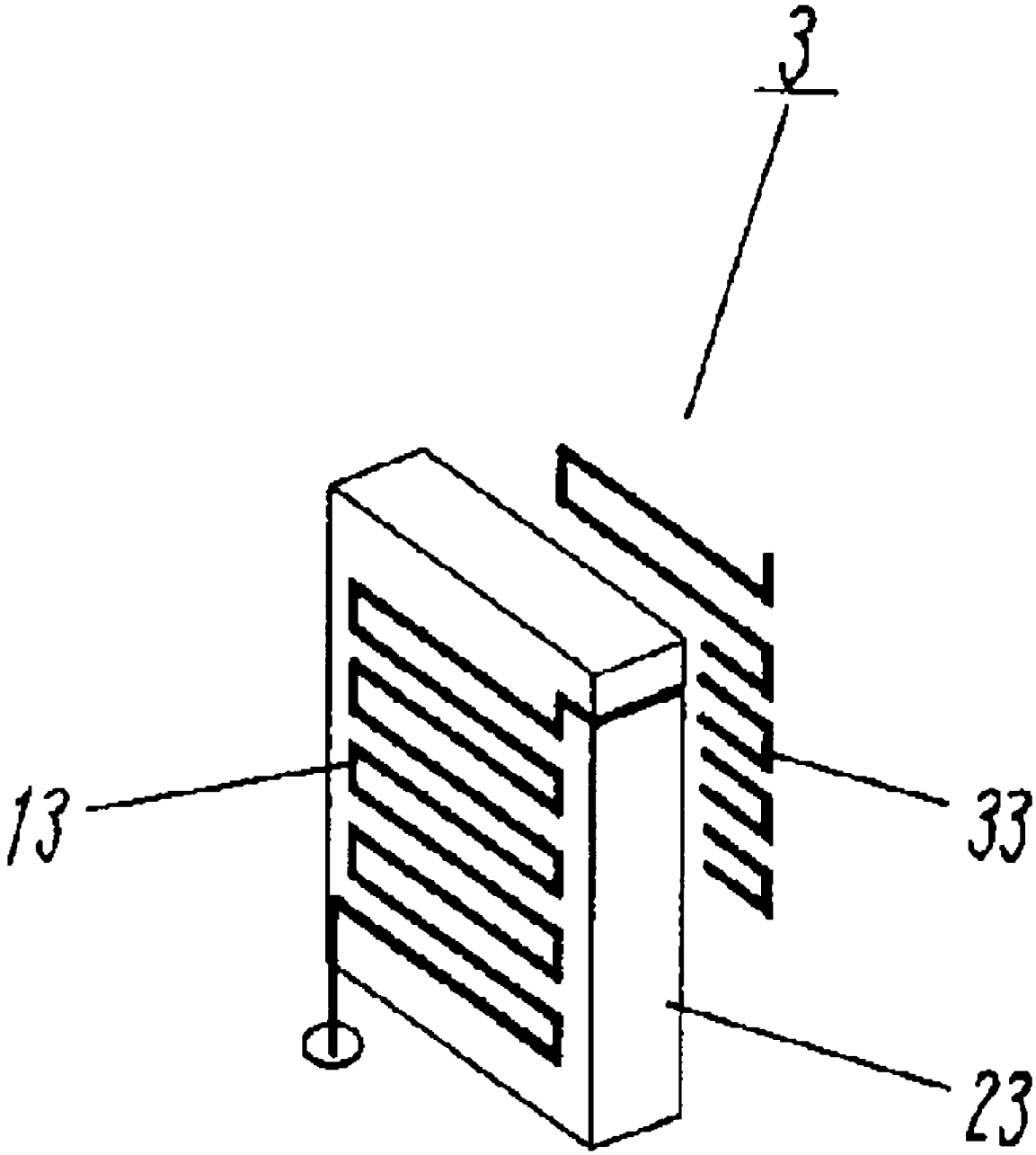
FIG. 10 is a perspective view of the antenna.
Figure 11:
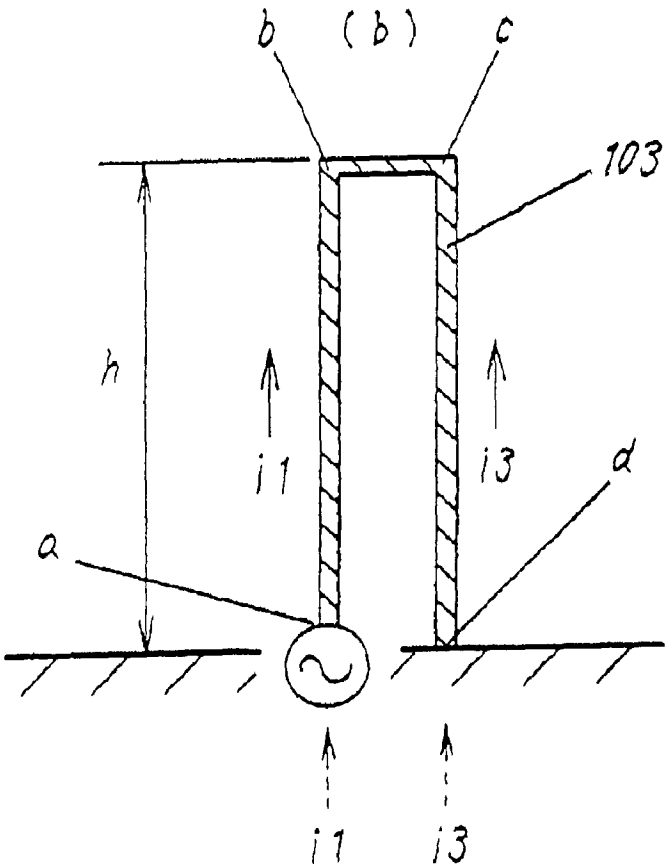
Fig. 11 PRIOR ART
FIG. 11(*a*) to FIG. (*b*) are side views of conventional antennas.
Figure 11:
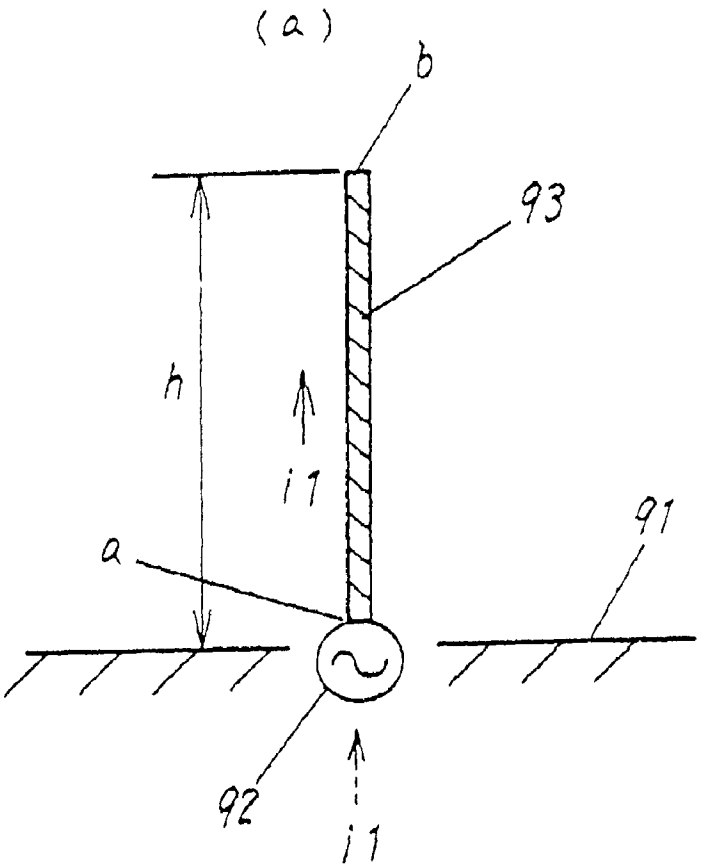
Fig. 11 PRIOR ART

Further, it is possible to use a configuration as shown in FIG. 10. That is, antenna element 33 with its one end connected to the ground plane 1 is disposed on the opposing surface of either one or both of the first antenna element 13 and the second antenna element 23. The intermediate portion of the antenna element 33 is same in shape as the first antenna element 13 and is folded by a plurality of times with the other end opened. That is, in FIG. 10, there are further provided one or a plurality of parasitic antenna elements 33, and each of the parasitic antenna elements 33 is arranged in parallel relation to the surface where the first antenna element 13 and the second antenna element 23 are disposed. In such a configuration, high-frequency current flows in same phase to the antenna element 33 as well, enhancing the excitation, and it is possible to further expand the band of the antenna.

As described above, according to the present invention, the antenna element can be lowered in height and it is possible to obtain a small size antenna.

What is claimed is:

1. An antenna for receiving a current, comprising:

a flat-plate ground plane;

a first antenna element with its one end connected to a feeding point and its intermediate portion folded by a plurality of times, which is extended upward from said ground plane; and a second antenna element with its one end connected to the other end of said first antenna element and with the other end thereof connected to said ground plane, which has an intermediate portion extended upward from said ground plane, and wherein said first and second antenna elements each have an electrical length of over 1/4 wavelength relative to a frequency band of said current, a substrate extended upward from said ground plane, wherein the intermediate portion of said second antenna element is disposed in a symmetrical relation with the intermediate portion of said first antenna element, wherein the intermediate portion of said first antenna element and the intermediate portion of said second antenna element are arranged symmetrically opposed to each other, wherein the intermediate portion of said first antenna element is arranged on one surface of said substrate, and the intermediate portion of said second antenna element is arranged on the other surface opposed to the substrate surface where the intermediate portion of said first antenna element is disposed.

2. The antenna of claim 1, further comprising:

a conductive plate, wherein said conductive plate is arranged on one surface of said substrate being parallel to said ground plane, and the other end of said first antenna element and one end of said second antenna element are connected to each other via said conductive plate.

3. The antenna of claim 2, wherein said first antenna element and said second antenna element are formed of metal plates which are integral with said conductive plate.

4. The antenna of claim 1, wherein said first and second antenna elements each have an electrical length of 5/4 wavelength relative to said frequency band of said current.

5. The antenna of claim 2, wherein said first and second antenna elements each have an electrical length of 5/4 wavelength relative to said frequency band of said current.

6. The antenna of claim 3, wherein said first and second antenna elements each have an electrical length of 5/4 wavelength relative to said frequency band of said current.

7. An antenna, comprising:

a flat-plate ground plane;

a first antenna element with its one end connected to a feeding point and its intermediate portion folded by a plurality of times, which is extended upward from said ground plane; and a second antenna element with its one end connected to the other end of said first antenna element and with the other end thereof connected to said ground plane, which has an intermediate portion extended upward from said ground plane, and a substrate extended upward from said ground plane, wherein the intermediate portion of said second antenna element is disposed in a symmetrical relation with the intermediate portion of said first antenna element, wherein the intermediate portion of said first antenna element and the intermediate portion of said second antenna element are arranged symmetrically opposed to each other, wherein the intermediate portion of said first antenna element is arranged on one surface of said substrate, and the intermediate portion of said second antenna element is arranged on the other surface opposed to the substrate surface where the intermediate portion of said first antenna element is disposed, a plurality of parasitic antenna elements having an intermediate portion same in shape as the intermediate portion of said first antenna element, wherein each of said parasitic antenna elements are arranged in parallel relation to the surface where said first antenna element and said second antenna element are disposed, and one end of said parasitic antenna element is connected to said ground plane with the other end opened.

8. The antenna of claim 7, wherein said first and second antenna elements each have an electrical length of 5/4 wavelength relative to said frequency band of said current.

* * * * *

UNITED STATES PATENT AND TRADEMARK OFFICE

CERTIFICATE OF CORRECTION

PATENT NO. : 7,173,567 B2
APPLICATION NO. : 10/756982
DATED : February 6, 2007
INVENTOR(S) : Susumu Inatsugu et al.

It is certified that error appears in the above-identified patent and that said Letters Patent is hereby corrected as shown below:

Title Page, Item (56) line 2, References Cited, FOREIGN PATENT DOCUMENTS
Change "WO WO 03/003515 A" to -- WO 03/003515 A --

Signed and Sealed this

Tenth Day of July, 2007

JON W. DUDAS
*Director of the United States Patent and Trademark Office*